US008112824B2

(12) United States Patent
Spogardh

(10) Patent No.: US 8,112,824 B2
(45) Date of Patent: Feb. 14, 2012

(54) DOSING DEVICE FOR A TOILET

(75) Inventor: Stefan Danielsson Spogardh, Asarum (SE)

(73) Assignee: Ifo Sanitar AB, Bromolla (SE)

( * ) Notice: Subject to any disclaimer, the term of this patent is extended or adjusted under 35 U.S.C. 154(b) by 1060 days.

(21) Appl. No.: 11/579,515

(22) PCT Filed: May 5, 2004

(86) PCT No.: PCT/SE2004/000691

§ 371 (c)(1),
(2), (4) Date: Dec. 20, 2007

(87) PCT Pub. No.: WO2005/106142

PCT Pub. Date: Nov. 10, 2005

(65) Prior Publication Data

US 2008/0189842 A1 Aug. 14, 2008

(51) Int. Cl.
*E03D 9/00* (2006.01)

(52) U.S. Cl. ..... 4/225.1; 4/222; 4/226.1; 4/227.1; 4/224

(58) Field of Classification Search ..... 4/222–224, 4/225.1, 226.1, 227.1
See application file for complete search history.

(56) References Cited

U.S. PATENT DOCUMENTS

| | | | | |
|---|---|---|---|---|
| 4,229,410 | A | 10/1980 | Kosti | |
| 4,312,082 | A * | 1/1982 | Murphy et al. | 4/225.1 |
| 4,962,549 | A | 10/1990 | King | |
| 5,073,992 | A * | 12/1991 | Herring et al. | 4/227.1 |
| 5,088,133 | A | 2/1992 | Chen | |
| 6,192,524 | B1 | 2/2001 | Black | |
| 6,339,850 | B1 | 1/2002 | Gore | |

FOREIGN PATENT DOCUMENTS

| | | |
|---|---|---|
| DE | 26 24 163 | 12/1977 |
| NO | 314950 | 6/2003 |
| WO | WO 03/044291 A1 | 5/2003 |

OTHER PUBLICATIONS

International Written Opinion for International Application No. PCT/SE2004/000691.

* cited by examiner

*Primary Examiner* — Steven J Ganey
(74) *Attorney, Agent, or Firm* — Merchant & Gould P.C.

(57) ABSTRACT

A dosing device for dosing chemicals (9) into outlet water for flushing a toilet having a toilet bowl. The dosing device comprises a place of dosing, at which outlet water and the chemicals are mixed during a flushing of the toilet. The place of dosing is arranged between an inlet to an overflow pipe (5) and an inlet to the toilet bowl.

11 Claims, 5 Drawing Sheets

DOSING DEVICE FOR A TOILET

TECHNICAL FIELD OF THE INVENTION

The present invention relates to a flush actuator unit having an inlet for introduction of chemicals for dosing chemicals into water at flushing of a toilet, where a dosing arrangement is connected to the inlet, and where connecting means are provided, connecting the inlet to a place of dosing.

DESCRIPTION OF RELATED ART

Toilets typically include a toilet bowl, which is adapted to receive solid and liquid waste and water, and a cistern, which provides a reservoir for the water, for flushing the waste from the bowl. A flushing device is mounted within the cistern, which is operable by a user from the outside of the cistern to initiate the flushing. The flushing device is also arranged to regulate the amount of water entering the bowl during the flushing process. A fill valve is also commonly mounted in the cistern to refill the cistern with a predetermined amount of water to be used during the next flushing process.

The flushing devices typically include a flush or outlet valve, a float valve and an actuation mechanism. By operation of the actuation mechanism, the outlet valve opens to release water from the cistern into the bowl and closes when the water reaches a predetermined lower level in the cistern. Similarly, the float valve opens when water is released from the cistern and closes when the water reaches a predetermined upper level in the cistern.

A dual-flush toilet provides the possibility to select between a large flush liquid volume for solid waste and a small flush liquid volume for liquid waste. Dual-flush toilets include a selection device mounted on the outside of the cistern, which selection device is connected to the outlet valve at the bottom of the cistern.

To ensure good hygiene of the toilet bowl a chemical substance, typically including both deodorant, anti-lime deposit, and sanitizing substances, is often mixed with the water. One solution for the dosing the chemical in the water includes a separate device containing the chemical substance that is introduced on the inside of the toilet bowl. Another solution comprises having an inlet dedicated for the purpose of introducing the chemical substance into the cistern. Still another solution comprises removing the lid of the cistern to apply the chemical substance into a fixedly mounted dosing device.

The chemical substance can be either in liquid or solid state, and dissolves when it contacts outlet water or is mixed with outlet water. The conventional devices for introduction of chemical substances to ensure good hygiene of the toilet bowl suffer from different drawbacks. The solution of placing a dispenser inside the toilet bowl gives an inefficient and uncontrolled way of dispensing the chemical substances. Having a separate inlet for introduction of the chemical substances requires a complicated construction of the toilet. Having a fixedly mounted dispenser device inside the cistern makes the refill of the chemical substances complicated.

WO-A1-03/044291 discloses a dispenser adapter for detergent dosing into a toilet cistern. The dispenser that is arranged inside the cistern and attached to the top of the toilet cistern comprises a bushing for attaching to the cistern, a dosing cage containing the detergent and a removable cap or closure for closing the dosing cage from the outside of the cistern. U.S. Pat. No. B1-6,374,426 discloses a dispenser for dosage of a chemical liquid for cisterns of toilet bowls. The dispenser has a separate opening for filling of the chemical liquid into the cistern for sanitizing of the toilet bowl. U.S. Pat. No. B1-6, 339,850 discloses a device for dispensing a solid chemical for sanitizing of a toilet bowl, where the device is located inside the cistern of the toilet. U.S. Pat. No. 4,962,549 discloses a device for sanitizing of a toilet bowl, where the device is to be positioned in the cistern of a toilet.

SUMMARY OF THE INVENTION

It is an object of the invention to provide an arrangement for simple dosing of chemicals chemical into outlet water for flushing a toilet.

According to a first aspect of the invention, the object is achieved by a dosing device for dosing chemicals into outlet water for flushing a toilet having a toilet bowl. The dosing device comprises a place of dosing, at which outlet water and the chemicals are mixed during a flushing of the toilet. The place of dosing is arranged such that chemicals, when held at the place of dosing, only get into contact with outlet water in movement when the dosing device is mounted in the toilet before an inlet to the toilet bowl.

The place of dosing may be arranged such that the chemicals when introduced into the dosing device is held by a holding device at the place of dosing. The place of dosing and the holding device may be arranged between an inlet to an overflow pipe and an inlet to the toilet bowl such that the outlet water and the chemicals are brought into contact during a flushing of the toilet. The holding device may be arranged in an overflow outlet of the overflow pipe such that the holding device, and the chemicals when received therein, is brought into contact with the outlet water entering into the overflow outlet during a flushing of the toilet. The overflow pipe may be connected to an outlet valve and may be moveable for opening the outlet valve for introducing outlet water into the place of dosing during a flushing of the toilet. Thus, the outlet water is not in contact with the chemicals when said water is contained in a cistern of the toilet. The holding device may be arranged to hold the chemicals in a liquid or a solid state. The holding device may be a receptacle arranged at the place of dosing. The receptacle may be provided with an arrangement of self-cleaning flanges arranged between the receptacle and the overflow pipe. Alternatively, the holding device is a mesh, a container, a pole or a cord. The holding device provided by a pole may have a fastening arrangement for attaching the chemicals to the pole.

The dosing device may comprise an inlet for introducing the chemicals to the place of dosing, the inlet being accessible from the outside of the toilet. Furthermore, the dosing device may comprise a flush actuator unit for initiating flushing of the toilet, said flush actuator unit being accessible from the outside of the toilet and may comprises the inlet for introducing the chemicals. The inlet may be connected by a connecting arrangement to the place of dosing.

An advantage of mixing the water and the chemical in the overflow pipe and not in the cistern for the sanitizing of the bowl is that only the overflow pipe needs to be resistant to chemicals, not the entire flushing device. This gives a better and cheaper manufacturing of the flushing device.

Yet another advantage is that the normal flushing path of the water is used to add/mix chemicals into the water on its way to the bowl. Another advantage of mixing the chemical with water in the overflow pipe is that the quality of the water in the cistern is maintained on a high level and thus fulfills the European water quality standard EN1717.

An advantage of the invention is that the actuator unit and the inlet for the chemical are arranged in a single device, which makes the manufacture of the device simpler and cheaper.

Still another advantage of the invention is that no additional opening needs to be made in the porcelain of the toilet, which makes the manufacture of the toilet simpler and cheaper.

Still another advantage of the invention is that it works equally well for a flushing of a large quantity of water or to initiate the flushing of a small quantity of water.

Still another advantage of the present invention is that the final quantity of flushing water includes a concentrated dosage of chemical substance since the water mixed in the chamber will be "pushed out of the chamber as the flushing mechanism completes the flushing and closes the passage for further water inflow.

Further embodiments of the invention are defined in the dependent claims.

BRIEF DESCRIPTION OF THE DRAWINGS

Further objects, features and advantages of the invention will appear from the following detailed description of the invention, reference being made to the accompanying drawings, in which.

DETAILED DESCRIPTION OF EMBODIMENTS

Figure 1:
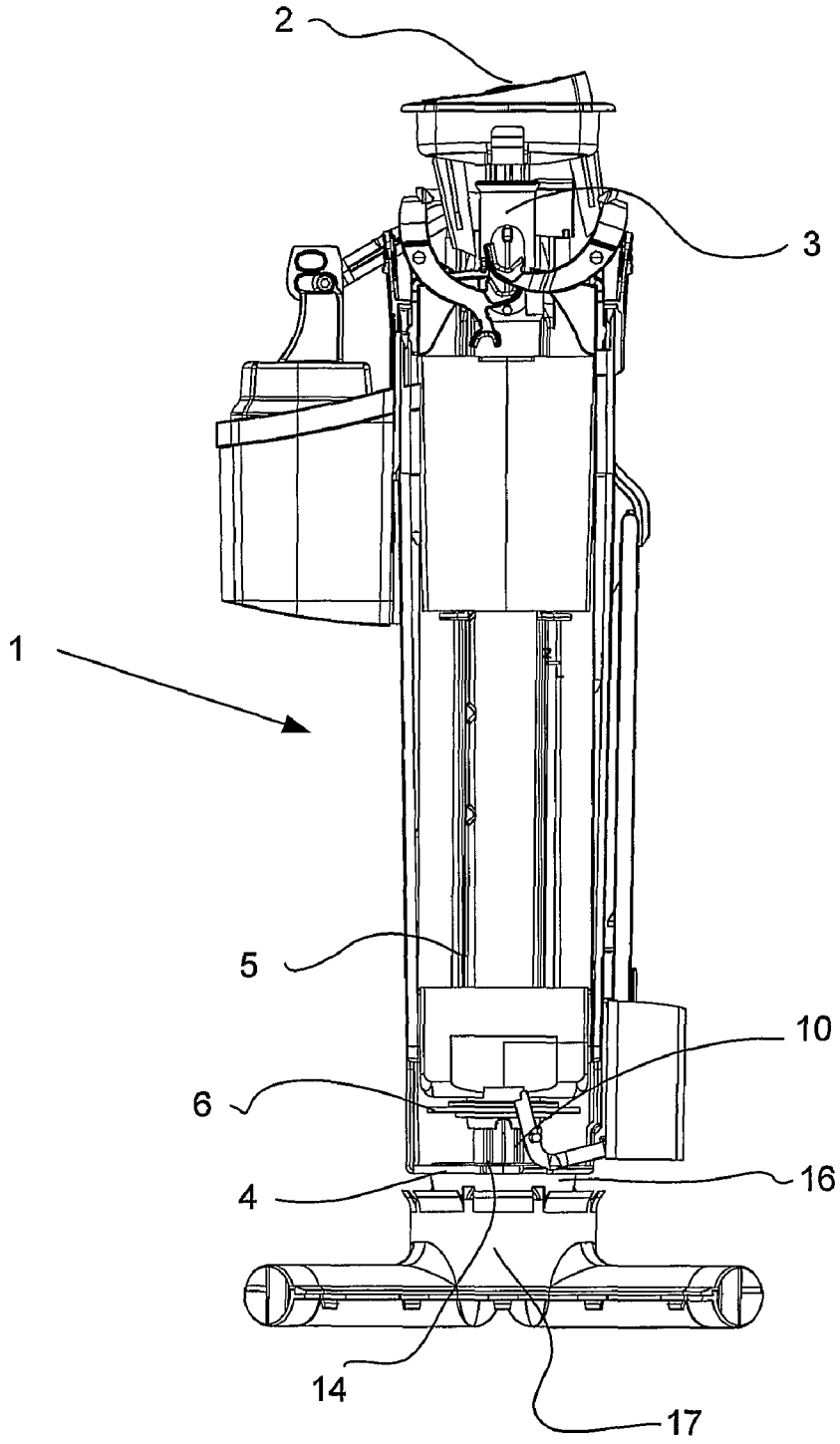
FIG. 1 is a cross-sectional view of the flushing mechanism.

FIG. 1 illustrates a mechanism 1 for flushing a toilet in a principal manner. The mechanism 1 is part of a flushing device to be mounted within a cistern of a toilet. The flushing device has a longitudinal axis from the top of the cistern to the bottom thereof. In the top a flush actuator unit 2 is arranged for initiating the flushing of the toilet. The flush actuator unit 2 may comprise a rocker button, which is pivotally attached to a frame, which may be inserted into a hole of the cover. Alternatively, two separate buttons are used, which act on a pivotally arranged lever. The rocker button or the two separate buttons are provided with a dual-flush mechanism to either initiate a flushing of a large quantity of water or to initiate the flushing of a small quantity of water. Yet another alternative is to have a conventional button that actuates a flushing with a single quantity of water.

To the flush actuator unit a pipe 3 is connected that extends downwards and connects to a directing means for directing chemicals introduced into the pipe 3 to a place of dosing. The directing means may be a fixed or displaceable overflow pipe. Alternatively, the directing means is a moveable pipe connected to and arranged to lift the outlet valve, but not used as an overflow pipe. In the embodiment of FIG. 1, the directing means is an overflow pipe 5 that extends downwards to an outlet 4 of the overflow pipe 5. The outlet 4 of the overflow pipe 5 is provided with an outlet valve 6, which prevents water to enter into the toilet bowl. When the flush actuator unit 2 is actuated, a lifting means will urge a connecting means that lifts the overflow pipe 5 and the outlet valve 6 towards the top of the cistern in the direction of the longitudinal axis of the flushing device, wherein water will flow out of the cistern through a passage 16. A major part of the water from the cistern will flow towards the toilet bowl and flush the bowl. A minor part of the water passing through the passage 16 will flow upwards through the outlet 4 of the overflow pipe 5 by a undertow into the overflow pipe 5.

Figure 2A:
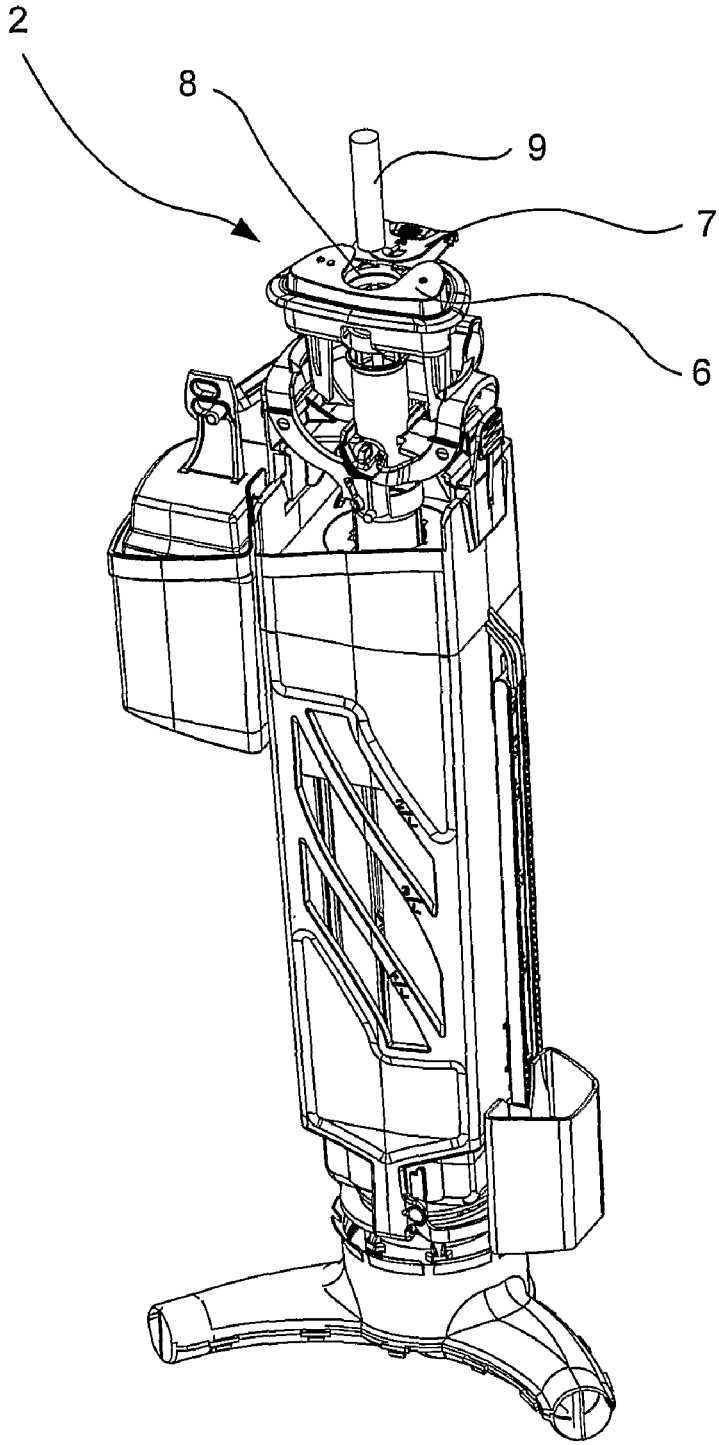
FIG. 2*a* is a perspective view of an actuator comprising an inlet for introducing chemicals to the dosing device.

In FIG. 2*a* the top part of the flush mechanism is shown including the flush actuator unit 2 that comprises the rocker button and a removable lid 7 covering an inlet 8 for introducing a chemical substance into the cistern of the toilet. Furthermore, a chemical rod or chemical tablet 9 is shown. The chemical rod 9 can be introduced into the inlet 8 by dropping the rod through the inlet.

Figure 2B:
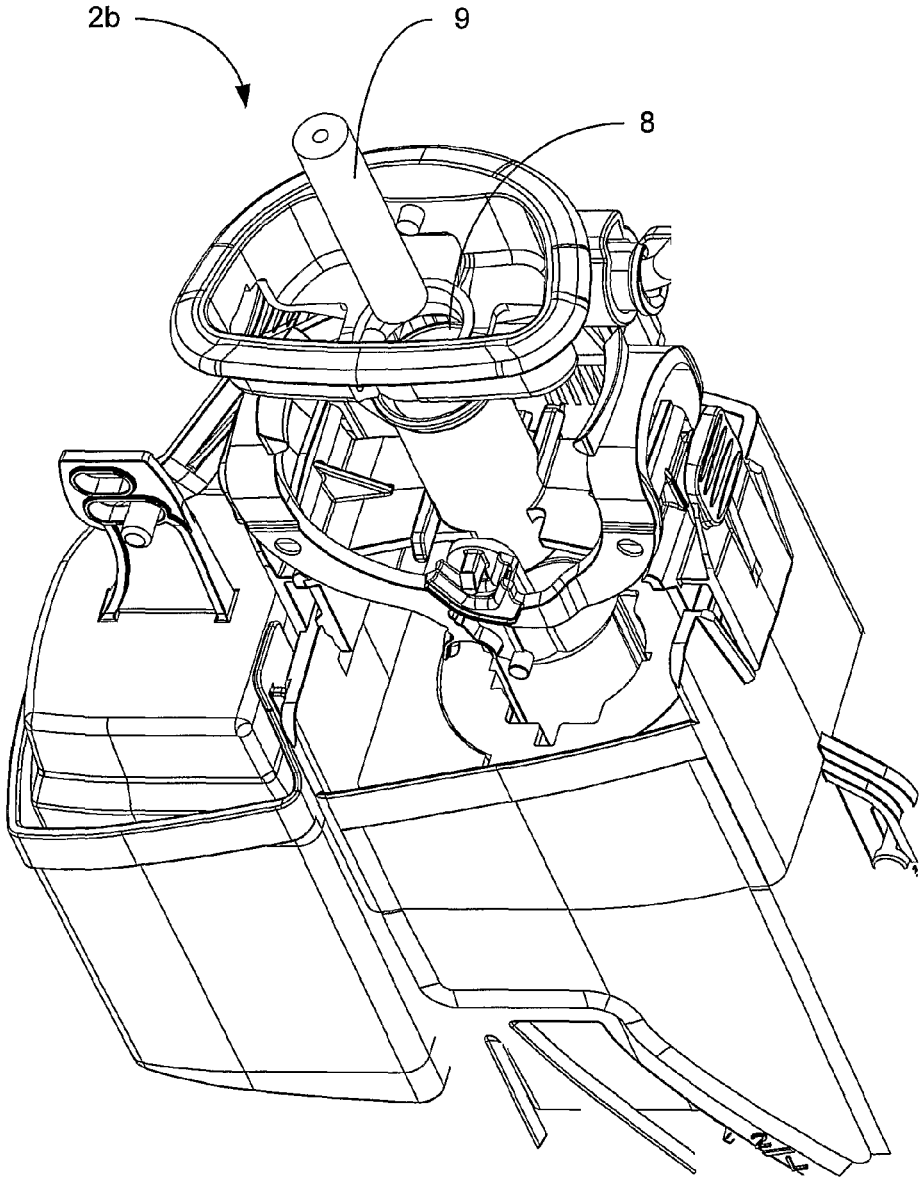
FIG. 2*b* is a perspective view of an alternative embodiment of the actuator comprising the inlet for introducing chemicals to the dosing device.

FIG. 2*b* illustrates an alternative embodiment of a flush actuator unit 2*b* that comprises an inlet 8*b* for introducing a chemical substance 9 into the cistern of the toilet, i.e. to the place of dosing. The rocker button is removable and flush actuator unit 2*b* is shown in FIG. 2*b* with the rocker button removed. The rocker button may be arranged to cover the inlet 8 when mounted for operation. Thus, the button is simply removed for introducing the chemical substance into the cistern of the toilet.

Still an alternative solution for accessing the place of dosing from the outside of the toilet is that the lid or the cistern comprises a separate hole connected to an inlet of the overflow pipe 5 for introducing chemicals therein.

According to the invention, the place of dosing, wherein chemicals are mixed with outlet water, may be between the inlet to the overflow pipe 5 and an inlet to the toilet bowl. Furthermore, the chemicals may be stored at the place of dosing. I.e. the place of dosing is in the transportation path of the outlet water, such that the chemicals and outlet water in movement are brought into contact only during the flushing process of the toilet. Thus, outlet water contained in a cistern of the toilet is not in contact with the chemicals until it flows out of the cistern.

The rod 9 may be directed by the pipe 3 into the overflow pipe 5 and further by gravity into a receptacle 10 arranged in the vicinity of the overflow outlet 4, i.e. the place of dosing. The rod 9 can also be attached to a pole (not shown) and be pushed down to the receptacle 10. The means for holding or fastening the rod to the pole can be a jamming arrangement, a gripping arrangement, a screw arrangement penetrating the chemical or any other mechanical arrangement for holding a tablet or rod. The chemical tablet or rod 9 can also be placed in a container or attached to a cord and the cord is used to lower the rod or container through the inlet 8 and down to the receptacle 10. The chemical substance can also be in liquid state and then be filled into a container that is lowered through the inlet 8 and down to the receptacle 10.

Figure 3:
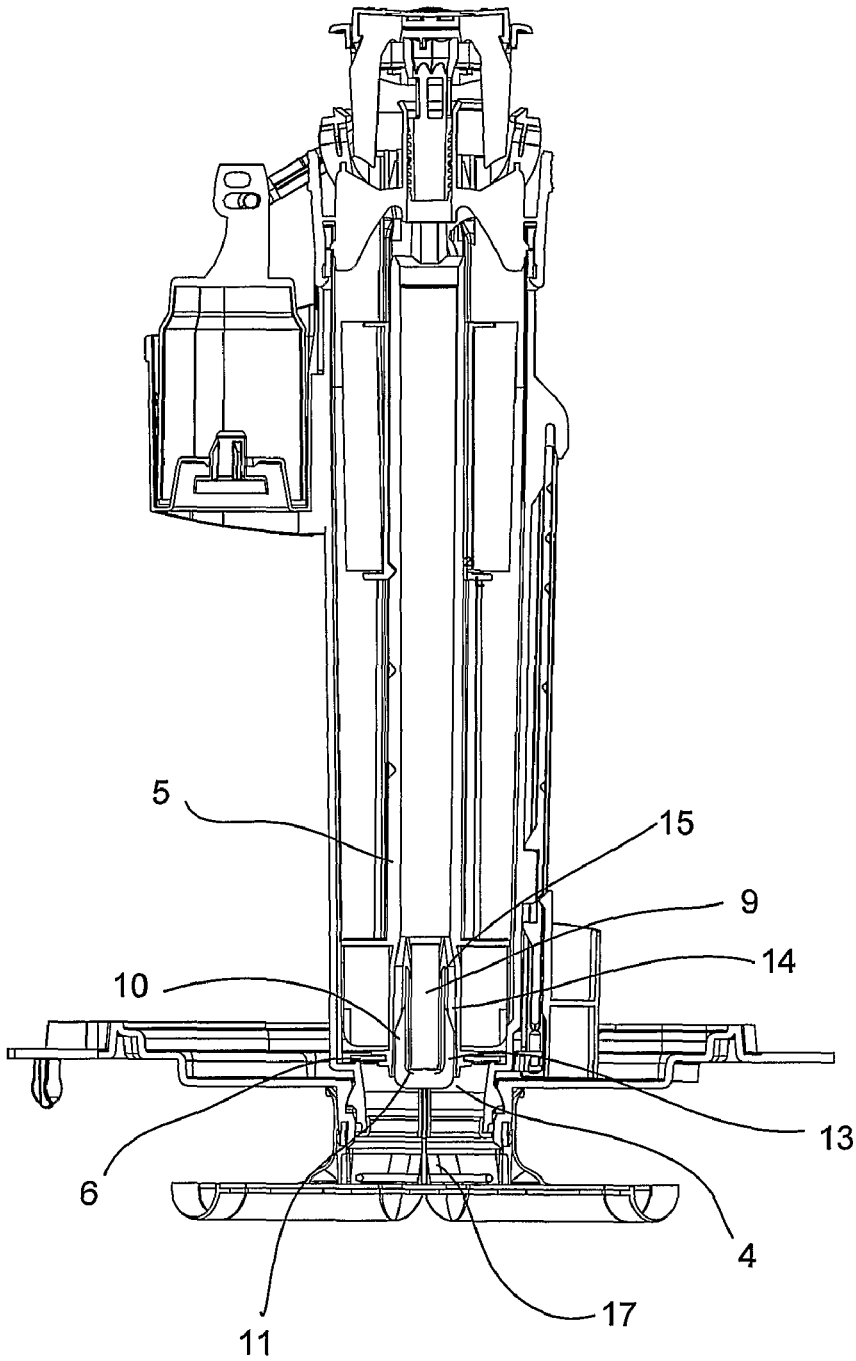
FIG. 3 is a cross-sectional view of a second embodiment of the dosing device according to the invention.

In FIG. 3 a lower part of the flushing mechanism of FIG. 1 is shown including the overflow outlet 4, the outlet valve 6 of the overflow outlet 4, the overflow pipe 5 connecting the inlet 8 to the overflow outlet 4, and a receptacle 10 for receiving the chemical rod 9. A chemical rod 9 may be located in the receptacle 10. A lower portion or end 11 of the receptacle 10 is facing the overflow outlet 4. The lower portion of the receptacle 10 is open to allow water from the overflow pipe 5 to pass in case of failure of the inlet valve and there is a need for overflowing. An upper portion 13 of the receptacle 10 is provided with ribs 14 to position the chemical rod 9, or a container with the chemical substance, in the receptacle 10. The ribs 14 interact with corresponding ribs 15 (shown in FIG. 4) arranged on the overflow pipe 5. The ribs 14 and 15 overlap each other so that the ribs 15 enter into the spaces between the ribs 14 and during a flushing removes anything located there, e.g. particles from the chemical tablet or rod 9.

Figure 4:
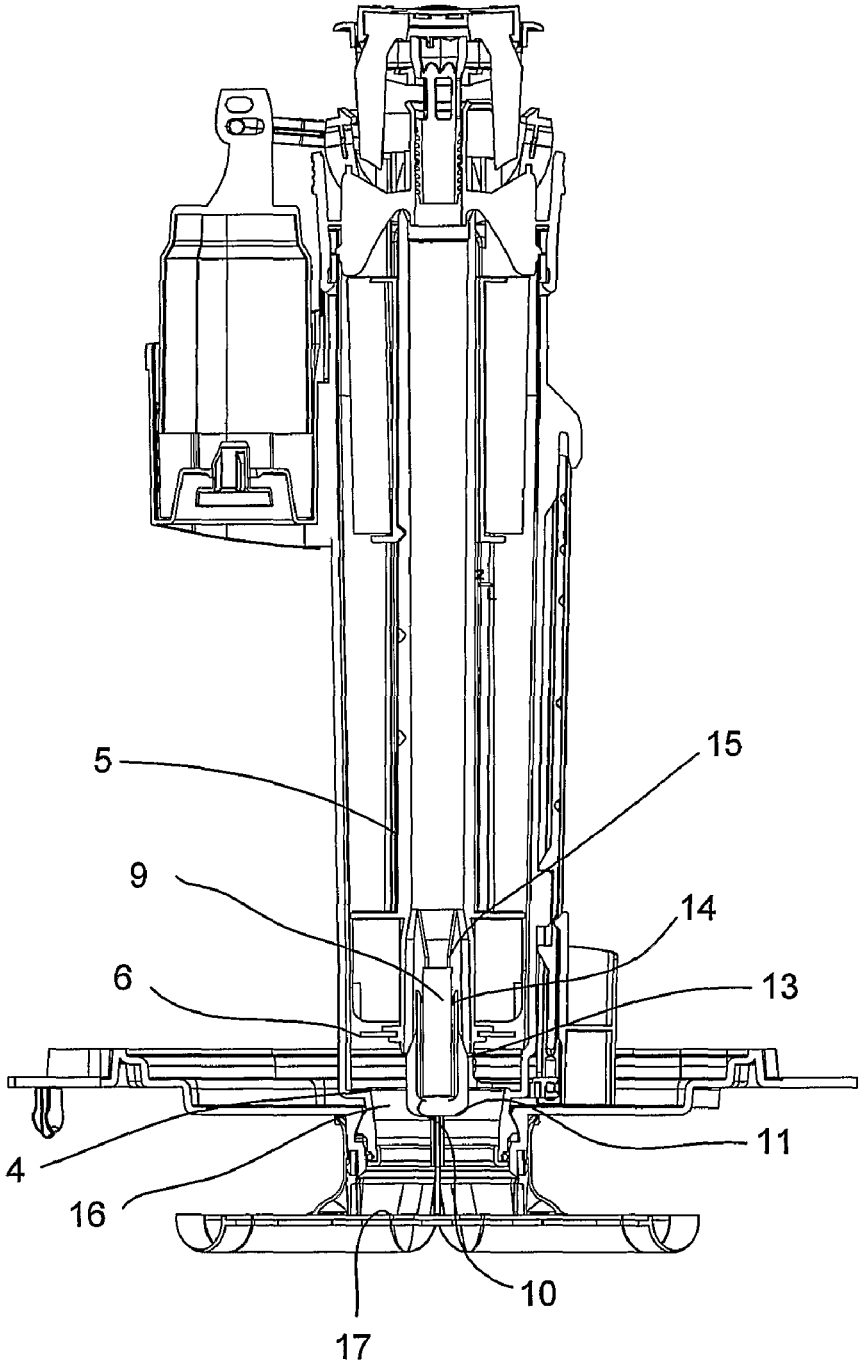
FIG. 4 is another cross-sectional view of a second embodiment of the dosing device according to the invention.

FIG. 4 also shows the lower part of the flushing mechanism from FIG. 1, but when a flushing has been initiated. The outlet valve 6, the overflow pipe 5 and the ribs 15 are all lifted and separated from the ribs 14 by the flushing mechanism making water to enter into the overflow pipe 5 by the undertow created when the outlet valve and other part of the flushing mechanism is lifted. The water will overflow the receptacle 10 through the spaces between the ribs 14, cleaning the space, and partially dissolve the chemical substance contained in the receptacle 10. The water mixed with the dissolved chemical substance is thereafter pushed out of the overflow pipe 5 through the receptacle 10 and the outlet 4 and further transported via the distributor passage 17 to the toilet bowl for sanitizing by normal means.

If a liquid chemical substance is contained in the receptacle instead of the solid chemical substance a portion of the liquid will mix with water and otherwise the principle is the same as discussed in connection with the solid chemical substance.

As an alternative the receptacle 10 is removed and the chemical 9 is freely movably located in the overflow pipe or distributor passage 17 and will typically dissolve completely at the flushing, i.e. the disposable article, which might be good if the user believes that he/she should initiate the sanitizing of the toilet bowl or if a especially powerful chemical substance is used for major sanitizing of the toilet bowl.

Another alternative is that the receptacle 10 is also removed, but another holding means is located over the outlet valve to hold the chemical. This holding means can be a circular mesh having the same diameter as the inside diameter of the overflow pipe. The chemical dissolves slowly by each flushing and finally the chemical is so small that the rest of the chemical will follow with the outgoing water.

A third alternative is that the overflow pipe is arranged to have the form of the received chemical or being arranged so that the overflow pipe have sections of different diameter so that the overflow pipe will hold the chemical in place by its design. The chemical will dissolve by the overflowing water as earlier described. When the rest of the chemical is smaller than the outlet from the overflow pipe, it will be transported out of the overflow pipe by the outgoing water. Alternatively can the outlet of the overflow pipe be provided with a perforated cover.

A fourth alternative embodiment is that a mesh or another perforated media is arranged in the overflow pipe or in the distributor passage 17 so that the chemical substance is transported to this location via the overflow pipe. The chemical dissolves slowly by each flushing and finally the chemical is smaller than the holes of the mesh or the perforated media that the rest of the chemical will follow with the outgoing water.

A fifth alternative embodiment is that the chemical is arranged freely in the place of dosing by and of the previously shown embodiments and that the chemical is lifted by the water entering into the place of dosing to ensure that it is the final quantity of water to flush the toilet bowl that includes chemical mix.

In the description, relative terms, such as upper and lower, have been used for indicating the mutual relationship between different parts of the invention when positioned for operation. As is understood, the parts could have another mutual relationship when the invention is not positioned for operation.

The present invention should not be limited to the shown embodiments; several modifications within the scope of the appended claims are possible.

The invention claimed is:

1. A dosing device for dosing chemicals into outlet water for flushing a toilet having a toilet bowl, said dosing device comprising a place of dosing, at which outlet water and the chemicals are mixed during a flushing of the toilet, wherein the place of dosing is arranged such that chemicals, when held at the place of dosing, only get into contact with outlet water in movement when the dosing device is mounted in the toilet before an inlet to the toilet bowl; wherein the place of dosing is arranged such that the chemicals when introduced into the dosing device is held by a holding device at the place of dosing; and wherein the place of dosing and the holding device are arranged between an inlet to an overflow pipe and the inlet to the toilet bowl such that the outlet water and the chemicals are brought into contact during the flushing of the toilet.

2. The dosing device according to claim 1, wherein the overflow pipe is connected to an outlet valve and is moveable for opening the outlet valve for introducing outlet water into the place of dosing during a flushing of the toilet.

3. The dosing device according to claim 1, wherein the holding device is arranged in an overflow outlet of the overflow pipe such that the holding device, and the chemicals when received therein, is brought into contact with the outlet water entering into the overflow outlet during a flushing of the toilet.

4. The dosing device according to claim 1, wherein the holding device is arranged to hold the chemicals, which are in a liquid or a solid state.

5. The dosing device according to claim 4, wherein the holding device is a pole having a fastening arrangement for attaching the chemicals to the pole.

6. The dosing device according to claim 1, wherein the holding device is a receptacle arranged at the place of dosing.

7. The dosing device according to claim 6, wherein the receptacle is provided with an arrangement of self-cleaning flanges arranged between the receptacle and the overflow pipe.

8. The dosing device according to claim 1, wherein the holding device is a mesh, a container, a pole or a cord.

9. The dosing device according to claim 1, wherein the dosing device comprises an inlet for introducing the chemicals to the place of dosing, the inlet being accessible from the outside of the toilet.

10. The dosing device according to claim 9, further comprising a flush actuator unit for initiating flushing of the toilet, said flush actuator unit is accessible from the outside of the toilet and comprises the inlet for introducing the chemicals.

11. The dosing device according to claim 9, wherein the inlet is connected by a connecting arrangement to the place of dosing.

* * * * *